US005600980A

United States Patent [19]

Fabian

[11] Patent Number: 5,600,980

[45] Date of Patent: Feb. 11, 1997

[54] EASY START IGNITION SWITCH ADAPTER

[76] Inventor: Joseph R. Fabian, 307 First Ave., North, Lewistown, Mont. 59457

[21] Appl. No.: 542,928

[22] Filed: Oct. 13, 1995

[51] Int. Cl.[6] ..... E05B 19/00

[52] U.S. Cl. ..... 70/408; 70/252; 74/528; 74/557

[58] Field of Search ..... 70/395, 397, 398, 70/252, 456 R, 375, 408; 74/528, 557; 200/331; 180/316, 320; 16/110 R; 81/177.2; D8/300, 306–308, 321

[56] References Cited

U.S. PATENT DOCUMENTS

| | | | |
|---|---|---|---|
| 4,285,536 | 8/1981 | McCoy et al. | 292/336.3 |
| 4,324,308 | 4/1982 | Clendenen | 70/254 X |
| 4,910,983 | 3/1990 | Taylor | 70/456 R |

*Primary Examiner*—Lloyd A. Gall
*Attorney, Agent, or Firm*—Jacobson, Price, Holman & Stern, PLLC

[57] ABSTRACT

An easy start adapter secured to the actuator of an automotive vehicle ignition switch and steering shaft lock. The adapter is in the form of a pair of clamp members adapted to be securely clamped to the diametrically opposed projecting wings or lugs utilized on existing steering column mounted ignition switches which operate the ignition circuit and also actuate the vehicle starter motor and lock and unlock the steering control shaft within the steering column. The clamp is provided with an elongated lever arm rigidly and adjustably secured thereto oriented generally in perpendicular relation to the rotational axis of the ignition key and lock cylinder which receives the ignition key in order to enable a vehicle operator to apply the necessary force to the ignition switch actuator to start the vehicle even though the vehicle operator has physical conditions that would not enable actuation of the ignition switch by conventionally engaging the usually provided ignition key diametrically opposed wings or lugs.

6 Claims, 1 Drawing Sheet

FIG. 1
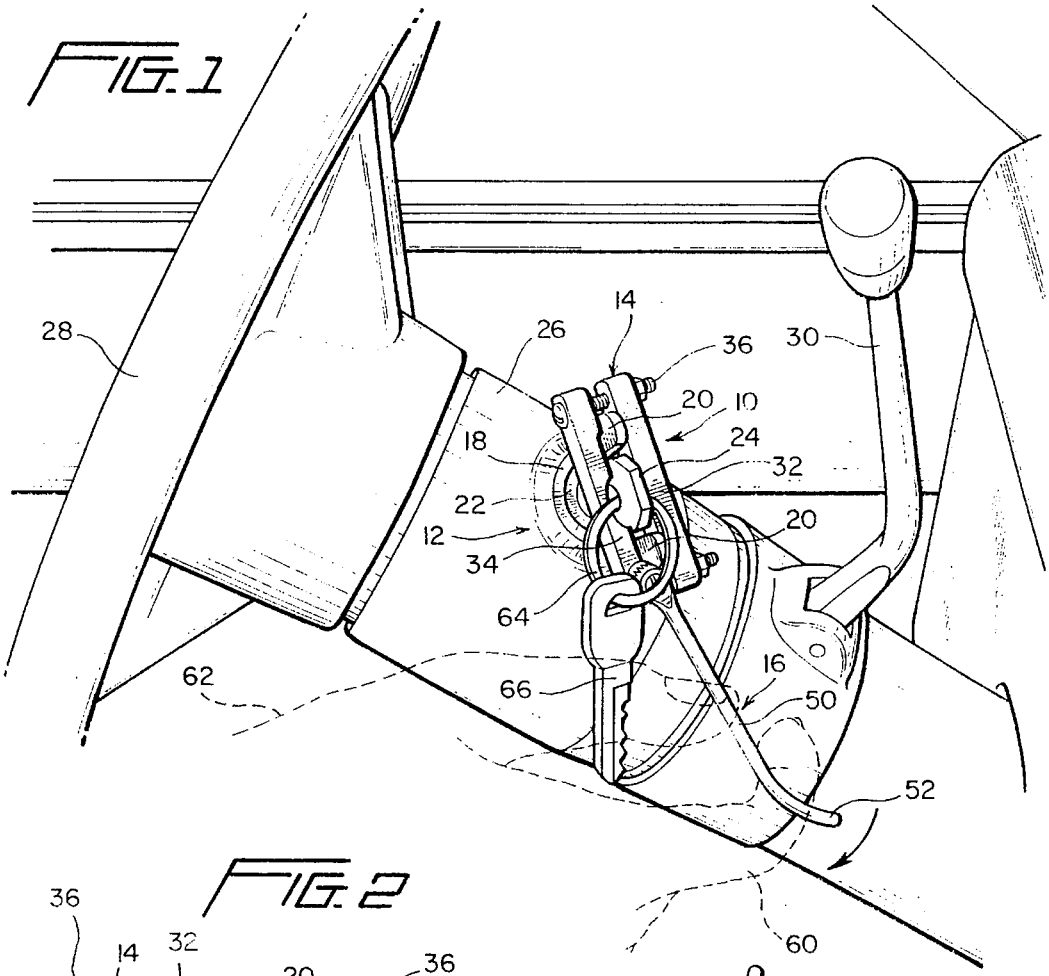
FIG. 2
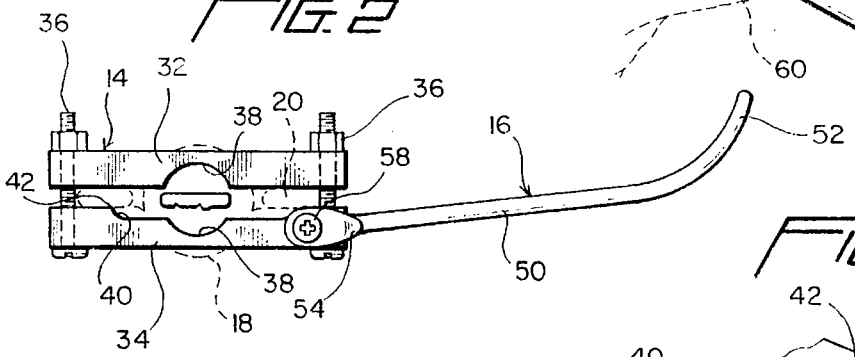
FIG. 4
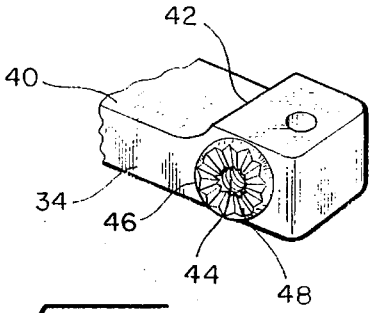
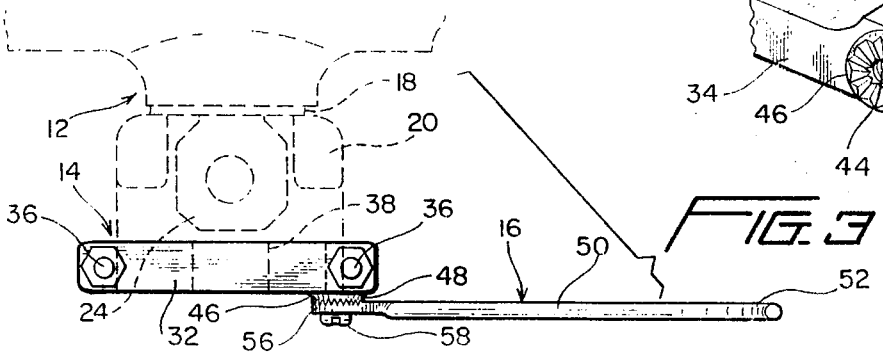
FIG. 3

EASY START IGNITION SWITCH ADAPTER

BACKGROUND OF THE INVENTION

1. Field of the Invention

This invention relates to an easy start adapter secured to the actuator of an automotive vehicle ignition switch and steering shaft lock. The adapter is in the form of a pair of clamp members adapted to be securely clamped to the diametrically opposed projecting wings or lugs utilized-on existing steering column mounted ignition switches which also actuate the vehicle starter and lock and unlock the steering shaft within the steering column. The clamp is provided with an elongated lever arm rigidly and adjustably secured thereto oriented generally in perpendicular relation to the rotational axis of the ignition key and lock cylinder which receives the ignition key. This enables a vehicle operator to apply sufficient rotational force to the ignition switch actuator through the elongated lever arm to rotate the ignition switch actuator to the engine "start" position even though the vehicle operator has physical conditions that would not enable actuation of the ignition switch by engaging the usually provided diametrically opposed wings or lugs.

2. Description of the Prior Art

Present day automotive vehicles utilize an ignition switch mounted on the steering column of a vehicle immediately below the steering wheel. The ignition switch not only operates the ignition circuit but also the starter motor circuit and locks and unlocks the steering shaft within the steering column to prevent rotation of the steering wheel when the ignition switch is in a locked condition. This type of ignition switch includes a lock cylinder having a slot to receive the ignition key and an actuator in the form of an annular ring secured to and oriented peripherally of the ignition lock cylinder with the annular ring including a pair of diametrically opposed radially and axially extending wings or lugs which enable a vehicle operator to insert the key into the lock cylinder and then engage the wings or lugs and the ignition key with the thumb and forefinger in order to partially rotate the ignition switch actuator to a position to close the ignition switch, actuate the starter or move the ignition switch to an accessory position if desired. The ignition switch structure includes a spring biased feature which must be overcome to move the ignition switch to a position to energize the vehicle's starter with this spring bias returning the ignition switch to a position with the ignition circuit closed after the vehicle has started and the wings or lugs are released.

Some vehicle operators do not have strength characteristics sufficient to effectively rotate the ignition switch actuator to the "start" position. Other vehicle operators may have physical conditions, such as arthritis, which makes the actuation of the ignition switch actuator painful or very difficult to accomplish especially when considering the orientation of the ignition switch actuator in closely underlying relation to the steering wheel of the vehicle.

Some efforts have been made to provide adapters or attachments to manually rotatable actuators to provide a lever arm to more easily rotate the actuators against a spring biased or other restraining force. The following U.S. patents relate to this field of endeavor.

| | |
|---|---|
| 1,219,344 | 4,036,040 |
| 1,381,259 | 4,783,883 |
| 3,507,259 | 4,821,372 |
| 4,018,465 | D304,994 |

The above listed patents do not disclose the clamp structure and lever arm arrangement of this invention in which the position of the lever arm is adjustable and the clamp structure effectively secures the attachment to the ignition key actuator.

SUMMARY OF THE INVENTION

An object of the present invention is to provide an easy start ignition switch adapter which is mounted directly to an existing vehicle switch actuator without any modification whatsoever to the existing vehicle switch.

Another object of the invention is to provide a vehicle ignition switch adapter which includes a clamp for securely mounting the adapter on the existing projecting wings on a vehicle switch actuator.

A further object of the invention is to provide an ignition switch adapter in accordance with the preceding objects together with a lever arm adjustably and rigidly mounted on the clamp and oriented in perpendicular relation to the rotation axis of the vehicle ignition switch to enable rotational force or torque to be applied to the vehicle switch actuator through an elongated lever arm with the adjustment of the lever arm enabling the initial position of the lever arm to be adjusted for optimally relating the lever arm to the steering wheel and in optimum relation to a vehicle operator to enable application of force to the free end of the lever arm.

Another important object of the invention is to provide a vehicle ignition switch adapter to enable a vehicle operator to grasp the outer end of a lever arm and exert a rearward and upward force thereon to rotate the ignition switch actuator even though the vehicle operator may have some degree of disfunction of the hands, fingers and arms.

A still further object of the invention is to provide a vehicle ignition switch adapter in accordance with the preceding objects in which the clamp securing the adapter to the ignition switch actuator does not interfere with the insertion of and removal of the ignition key with respect to the ignition lock cylinder.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the ignition switch adapter of the present invention illustrating its association with the existing ignition lock actuator and ignition key and showing the association of the adapter with respect to the steering column of the vehicle.

FIG. 2 is a side elevational view of the vehicle switch adapter.

FIG. 3 is a top plan view of the vehicle switch adapter illustrating its association with the vehicle switch actuator.

FIG. 4 is a fragmental perspective view illustrating a serrated portion of one end of one of the clamp members to enable adjustment of the lever arm.

DESCRIPTION OF THE PREFERRED EMBODIMENT

Referring now specifically to the drawings, the easy start ignition switch adapter of the present invention is designated by reference numeral 10 and is attached to a conventional vehicle ignition switch assembly 12 and includes a clamp structure 14 and a lever arm 16. The adapter is mounted on existing vehicular structure without modification and is associated with a vehicle ignition switch actuator 18 having a pair of diametrically opposed, radially and axially extending wings or lugs 20 integral therewith which are normally engaged by the thumb and forefinger to exert rotational force on the actuator 18 to enable rotation of the ignition lock cylinder 22 when the ignition key 24 has been inserted into the slot formed in the lock cylinder 22.

As illustrated, the vehicle ignition switch is mounted on the steering column 26 below the steering wheel 28 and adjacent the gear shift lever or selector 30. Usually, the ignition lock is oriented in a position for grasping the wings or lugs 20 with the right hand which must be moved into underlying relation to the steering wheel. This sometimes makes it difficult to rotate the vehicle switch actuator from the ignition circuit closing position to the starter motor circuit closing position in view of the spring resistance to movement of the switch actuator 18 to the "start" position since the switch actuator 18 is spring biased back to the ignition or "run" position after the vehicle engine has started and the force necessary to rotate the switch actuator to the "start" position has been released. The function and structure of the existing ignition switch including the movement to the various positions of the switch and the function of the switch including locking and unlocking the steering shaft within the steering column and movement to an accessory position are all maintained and not changed or modified in any way by the attachment of this invention.

The clamp 14 which mounts the adapter to the wings or lugs 20 includes a pair of clamp members 32 and 34 in the form of rigid, elongated bars which straddle and receive the wings or lugs 20 with clamp bolts 36 extending through the ends of the clamp members 32 and 34 in order to securely mount the clamp 14 on the wings or lugs 20. The facing surfaces of the clamping members 32 and 34 each include a recess 38 which may be generally semicircular or partially circular in order to not interfere with insertion and removal of the ignition key 24 with respect to the lock cylinder 22. To provide some additional clearance for insertion of the ignition key 24 in certain vehicle models in which the key is offset in relation to the wings or lugs 20 and to provide a secure gripping engagement with the wings or lugs 20, the clamp bar 34 includes a shallow longitudinal recess 40 defining a shoulder 42 at each end thereof for secure clamping engagement with the wings or lugs 20. The end of the clamping member 34 oriented downwardly below the switch actuator is provided with an internally threaded bore 44 surrounded by a projecting boss 46 that is provided with a plurality of radial serrations 48.

The lever arm 16 is in the form of an elongated substantially rigid rod 50 having a laterally curved outer end 52 which curves generally downwardly and forwardly when the adapter has been installed on the switch actuator as illustrated in FIG. 1. The other end of the rod 50 is apertured and flattened at 54 and provided with radial serrations 56 for locking engagement with the serrations 48 on the boss 46 on the clamp member 34. A clamp screw 58 extends through the flattened end 54 of the rod 50 and threads into the internally threaded bore 44 to enable the rod 50 to be adjusted angularly about the axis of the screw 58 and securely locked in adjusted position as will be apparent from FIGS. 2–4.

When installing the adapter, the clamp bolts 36 are loosened sufficiently to enable the clamp 14 to be slipped over the wings or lugs 20 and moved axially inwardly as far as possible. The wings or lugs 20 are engaged by the surface of clamp member 32 and the surfaces 43 on clamp member 34 outwardly of shoulders 42. The bolts 36 are tightened to securely mount the clamp on the switch actuator 18. The lever arm 16 may then be adjusted into optimum position by loosening the clamp screw 58 sufficiently to enable the rod 50 to be moved in an arcuate manner so that the forwardly and downwardly curved end 52 does not interfere with operation of the shift lever 30 but yet positioning the lever arm 16 in an optimum position for a vehicle operator to place the forefinger 60 or multiple fingers and the thumb on the hand 62 into engagement with the lever arm 16 to pull it to the rear and upwardly about the rotational axis of the lock cylinder 22 thereby moving the ignition switch actuator to a "start" position by overcoming the resilient bias built into the ignition switch assembly. This enables the vehicle to be easily started even by vehicle operators having minimal physical strength and dexterity characteristics or having arthritis or other conditions which reduce the capability of movement of the hands, fingers and arms. Adjustment of the lever arm also enables the lever arm to be oriented in a position that it will not interfere with normal operation of the vehicle including movement of the foot, leg and knee of the vehicle operator when operating the vehicle accelerator and foot brake.

The components of the attachment may be constructed of plastic material by injection molding or metal by using standard techniques and constructed so that it does not mar or damage the existing ignition lock device. The separate nuts 36 may be cast into, molded into or press fitted into a cavity to eliminate the possibility of misplacing the nuts and also simplifying installation of the adapter. The total length of the clamp and lever arm may be on the order of 6 inches. Also, the lever arm may be secured in place by a through bolt to eliminate the necessity of internally threading the bore 44. The width of the clamp members is such that the outer surface thereof will be inwardly of the normally provided aperture through the ignition key 24 thereby enabling a key ring 64 and other keys 66 to be supported from the key ring and ignition key. Also, the attachment does not exert any rotational or torque force on the ignition key itself inasmuch as all forces are exerted on the wings or lugs 20 on the ignition switch actuator 18.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An easy start vehicle ignition switch adapter for a vehicle ignition switch which includes a lock cylinder actuator with diametrically opposed projections thereon which can be engaged to partially rotate the actuator for closing an ignition circuit and closing a circuit to a vehicle starter motor, said switch actuator being spring biased against movement to starter motor circuit closing position and to return the switch actuator to ignition circuit closing position after the vehicle starter motor has been actuated to start a vehicle engine and rotational force has been released from the switch actuator, said adapter comprising clamp means adapted to be mounted on said projections on the actuator, an elongated lever arm mounted on said clamp means and extending in generally perpendicular relation to the axis of rotation of the ignition switch actuator to enable application of force on the lever arm to move the switch actuator to a vehicle starting position by a vehicle operator having limited physical strength characteristics or other conditions hampering application of force by the thumb and fingers engaging the switch actuator sufficient to move the switch actuator to vehicle starting position, wherein said clamp means includes a pair of clamp members, each of which includes a flat surface on an inwardly directed side, said flat surfaces of said inwardly directed sides of said clamp members for straddling and engaging opposed outer sides of the projections on the switch actuator, clamp bolts at opposite ends of the clamp members to securely clamp the clamp members to the switch actuator projections.

2. The adapter as defined in claim 1 wherein facing, opposed surfaces of said clamp members includes recesses to provide access to the ignition lock cylinder actuator to enable an ignition key to be inserted and removed from the lock cylinder actuator.

3. The adapter as defined in claim 2 wherein said lever arm includes a flattened end attached to one of said clamp members, said flattened end and said one clamp member including coacting radial serrations to enable adjustment of the lever arm in relation to the clamp members, a screw threaded member extending through the flattened end of the lever arm and engaging said one clamp member to lock the serrations on the lever arm in adjusted position in relation to the serrations on said one clamp member to obtain optimum initial position of the lever arm in relation to the clamp members and vehicle ignition switch and optimum relation of the hand of a vehicle operator to the lever arm to enable sufficient force to be exerted on the lever arm to move the switch actuator to the starter motor circuit closing position by overcoming the spring bias by engaging the lever arm and pulling it toward the vehicle operator.

4. The adapter as defined in claim 1 wherein said lever arm includes a flattened end attached to said clamp means, said flattened end and said clamp means including coacting radial serrations to enable adjustment of the lever arm in relation to the clamp means, a screw threaded member extending through the flattened end of the lever arm and engaging the clamp means to lock the serrations on the lever arm in adjusted position in relation to the serrations on the clamp means to obtain optimum initial position of the lever arm in rotation to the clamp means and vehicle ignition switch and optimum relation of the hand of a vehicle operator to the lever arm to enable sufficient force to be exerted on the lever arm to move the switch actuator to the starter motor circuit closing position by overcoming the spring bias by engaging the lever arm and pulling it toward the vehicle operator.

5. In combination with a vehicle ignition switch adapter, a vehicle ignition switch which includes a lock cylinder actuator with diametrically opposed radial and axial projections thereon which can be engaged to partially rotate the actuator for closing an ignition circuit and closing a circuit to a vehicle starter motor, said switch actuator being spring biased against movement to starter motor circuit closing position and to return the switch actuator to ignition circuit closing position after the vehicle starter motor has been actuated to start a vehicle engine and rotational force has been released from the switch actuator, said adapter comprising clamp means mounted on said projections on the actuator, an elongated lever arm mounted on said clamp means and extending in generally perpendicular relation to the axis of rotation of the ignition switch actuator to enable application of force on the lever arm to move the switch actuator to a vehicle starting position by a vehicle operator having limited physical strength characteristics or other conditions hampering application of force by the thumb and fingers engaging the switch actuator sufficient to move the switch actuator to vehicle starting position wherein said clamp means includes a pair of clamp members straddling the projections on the switch actuator, clamp bolts interconnecting the ends of the clamp members to securely clamp the clamp members to the switch actuator projections, the facing, opposed surfaces of said clamp members including recesses to provide access to the ignition lock cylinder actuator to enable an ignition key to be inserted and removed from the lock cylinder actuator.

6. The combination as defined in claim 5 wherein said lever arm includes a flattened end attached to one of said clamp members, said flattened end and said one clamp member including coacting radial serrations to enable adjustment of the lever arm in relation to the clamp members, a screw threaded member extending through the flattened end of the lever arm and engaging said one clamp member to lock the serrations on the lever arm in adjusted position in relation to the serrations on said one clamp member to obtain optimum initial position of the lever arm in relation to the clamp members and vehicle ignition switch and optimum relation of the hand of a vehicle operator to the lever arm to enable sufficient force to be exerted on the lever arm to move the switch actuator to the starter motor circuit closing position by overcoming the spring bias by engaging the lever arm and pulling it toward the vehicle operator.

* * * * *